US005496189A

United States Patent [19]

Over et al.

[11] Patent Number: 5,496,189

[45] Date of Patent: Mar. 5, 1996

[54] ELECTRICAL CONNECTOR ASSEMBLY INCLUDING IMPROVED DECOUPLING RETARDATION MECHANISM

[75] Inventors: Gary L. Over, Harrisburg; Teresa K. Black, Etters; David T. Shaffer, Mechanicsburg, all of Pa.

[73] Assignee: The Whitaker Corporation, Wilmington, Del.

[21] Appl. No.: 326,303

[22] Filed: Oct. 19, 1994

[51] Int. Cl.[6] ..... H01R 13/62

[52] U.S. Cl. ..... 439/321

[58] Field of Search ..... 439/312–323

[56] References Cited

U.S. PATENT DOCUMENTS

| | | | |
|---|---|---|---|
| 3,594,700 | 7/1971 | Nava et al. | 339/89 R |
| 3,892,458 | 7/1975 | Clark | 339/90 R |
| 4,074,927 | 2/1978 | Ball | 339/89 M |
| 4,106,839 | 8/1978 | Cooper | 339/143 R |
| 4,109,990 | 8/1978 | Waldron et al. | 339/89 M |
| 4,165,910 | 8/1979 | Anderson | 339/89 M |
| 4,239,314 | 12/1980 | Anderson et al. | 439/321 |
| 4,268,103 | 5/1981 | Schildkraut et al. | 339/89 R |
| 4,291,933 | 9/1981 | Kakaris | 339/89 R |
| 4,484,790 | 11/1984 | Schildkraut et al. | 339/89 M |
| 4,487,470 | 12/1984 | Knapp et al. | 439/321 |
| 4,519,661 | 5/1985 | Brush, Sr. et al. | 339/89 M |
| 4,536,048 | 8/1985 | Schildkraut et al. | 339/89 M |
| 4,588,245 | 5/1986 | Schwartz et al. | 339/89 R |
| 4,648,670 | 3/1987 | Punako et al. | 339/89 R |
| 4,726,782 | 2/1988 | Hager et al. | 439/321 |
| 4,746,303 | 5/1988 | Cobraiville et al. | 439/321 |
| 4,793,821 | 12/1988 | Fowler et al. | 439/321 |
| 4,834,667 | 5/1989 | Fowler et al. | 439/321 |
| 5,046,964 | 9/1991 | Welsh et al. | 439/271 |
| 5,082,454 | 1/1992 | Tonkiss et al. | 439/320 |

*Primary Examiner*—Gary F. Paumen
*Assistant Examiner*—Hien D. Vu
*Attorney, Agent, or Firm*—Anton P. Ness

[57] ABSTRACT

An electrical connector assembly (10) of the type having a pair of mateable cylindrical plug and receptacle shells (18,22) secured together by a rotatable coupling ring (16). The connector assembly is provided with a decoupling retardation mechanism which includes engageable teeth (34) on the interior of the coupling ring (16) and a pair of leaf spring members (46,72) mounted to the plug shell (18) inwardly of the teeth (34). The leaf spring member (46,72) includes a fixed beam portion (62,82) having a projection (64,84) which engages the teeth (34). The sides of the teeth and the projection are steeper on one side than the other. The steeper side is the one which is engaged when the coupling ring (16) is rotated in the direction to decouple the shells (18,22). Accordingly, greater torque is required to decouple the shells than to couple the shells.

8 Claims, 4 Drawing Sheets

ELECTRICAL CONNECTOR ASSEMBLY INCLUDING IMPROVED DECOUPLING RETARDATION MECHANISM

BACKGROUND OF THE INVENTION

This invention relates to an electrical connector assembly of the type having a pair of mateable cylindrical shells secured together by a rotatable coupling ring and, more particularly, to an improved decoupling retardation mechanism for such an assembly which acts to negate vibrational effects tending to decouple the shells.

There is a continuing need to improve electrical connectors so that they meet rigid performance standards imposed by severe environmental requirements established by aerospace applications. During desired mating and unmating, the electrical connectors should be easily and quickly coupled and decoupled with the use of reasonable forces. Once mated and in use, however, electrical connector assemblies must remain connected despite vibrational and/or other forces which might be applied to the connector assembly and which might tend to decouple the connectors.

There have been numerous approaches in the past which have addressed the problem of maintaining an assembled pair of cylindrical electrical connectors together. One such approach is disclosed in U.S. Pat. No. 4,648,670, which in its specification discusses other patents which disclose other approaches. For various reasons, it remains a desire in the industry to provide an approach that achieves the substantial retardation forces needed to satisfy the present-day strict requirements established for aerospace applications.

It is therefore an object of the present invention to provide an electrical connector assembly of simple construction which has an improved decoupling retardation mechanism which allows desired coupling and decoupling but resists a substantial torque to prevent unwanted decoupling due to vibration and the like.

SUMMARY OF THE INVENTION

The foregoing and additional objects are attained in accordance with the present invention by providing an electrical connector assembly which comprises an electrical plug connector subassembly including a substantially cylindrical first shell having one or more first electrical contacts secured in a dielectric insert therein, and an electrical receptacle connector subassembly including a substantially cylindrical second shell having one or more second electrical contacts secured in a dielectric insert therein and mateable with the first contact in the first shell. The second shell has an external thread on a forward portion that is received over the forward portion of the first shell during connector mating. A coupling ring is rotatably mounted on the first shell and restrained from axial movement with respect thereto. The coupling ring is adapted to selectively couple and decouple the first shell and the second shell, and has an interior wall provided with an internal thread connectable with the external thread on the second shell for connecting the first and second shells together and thereby holding the first and second contacts in mated relationship.

According to this invention, there is provided means for retarding rotational movement of the coupling ring with respect to the first shell. The retarding means comprises an annular region extending around the interior of the coupling ring and having an inner circumferential surface provided with a plurality of engageable teeth. Each of the teeth has first and second generally straight sides meeting at an apex.

The first side has a steeper angle than the second side, with the first side leading the second side when the coupling ring is rotated to decouple the first shell from the second shell. The retarding means also comprises an annular channel formed by an inwardly extending wall of the coupling ring and an outwardly extending wall of the first shell. The channel is so located that the teeth occupy its outer surface between the walls. The retarding means also comprises a leaf spring member having a central portion mounted to the first shell within the channel and a pair of wings extending within the channel in opposite directions from the central portion each to a respective distal end disposed against the exterior of the first shell. Each of the wings has a radially outwardly extending projection having first and second sides at angles complementary to the first and second sides of the teeth, that engage the teeth to retard rotational movement of the coupling ring. Because of the differing steepness of the sides of the teeth, more torque is required to decouple the shells than to couple the shells.

In accordance with an aspect of this invention, each of the wings has a first generally arcuate portion extending from the central portion and disposed against the exterior of the first shell within the channel, and a second portion between the first portion and the distal end of each wing which is raised away from the exterior of the first shell, with the projection being on the second portion.

In accordance with another aspect of this invention, the exterior of the first shell within the channel is flatted under the second portion of each of the wings.

In accordance with a further aspect of this invention, the retarding means comprises a pair of the leaf spring members disposed on the first shell diametrically opposite each other.

In accordance with yet another aspect of this invention, the width of the channel in the axial direction provides slight clearance for the leaf spring member and prevents the leaf spring from skewing.

BRIEF DESCRIPTION OF THE DRAWINGS

The foregoing will be more readily apparent upon reading the following description in conjunction with the drawings in which like elements in different figures thereof are identified by the same reference numeral and wherein.

DETAILED DESCRIPTION

Figure 1:
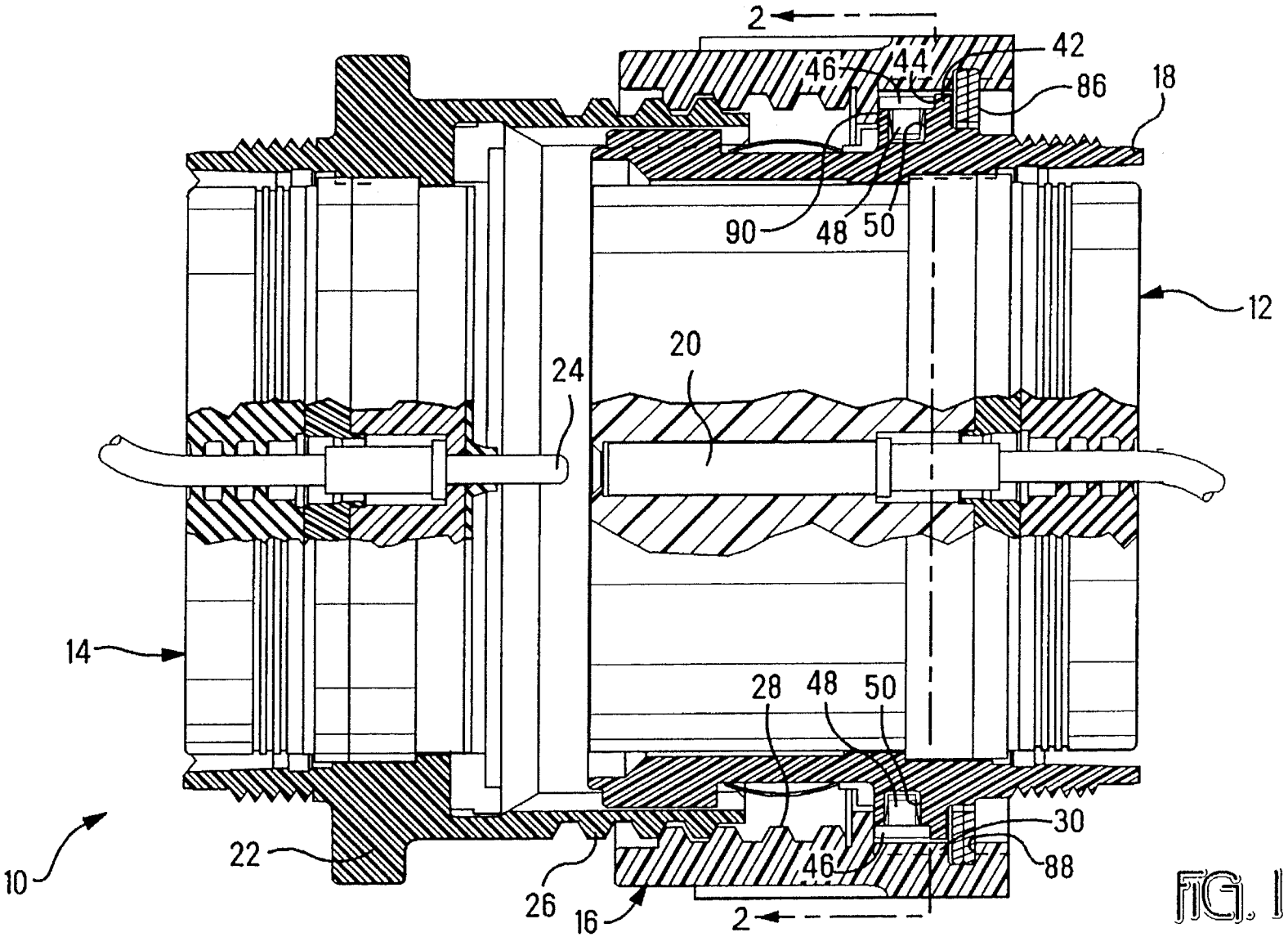
FIG. 1 is a cross sectional view of a partially mated electrical connector assembly according to the present invention taken along the line 1—1 in FIG. 2.

Referring now to the drawings, FIG. 1 shows an electrical connector assembly, designated generally by the reference numeral 10, constructed in accordance with the principles of this invention to include an improved decoupling retardation mechanism. As its main components, the assembly 10 includes an electrical plug connector subassembly 12, an electrical receptacle connector subassembly 14, and a coupling ring 16. As is conventional, the plug subassembly 12 includes a substantially cylindrical first shell 18 within which is secured at least one electrical contact 20. The receptacle subassembly 14 includes a substantially cylindrical second shell 22 having secured therein at least one electrical contact 24 mateable with the contact(s) 20 of the plug subassembly. The shell 22 is formed at its forward mating end with an external thread 26. The coupling ring 16 is rotatably mounted on the first shell 18 and is restrained from axial movement with respect thereto. An interior wall of the coupling ring 16 has an internal thread 28 connectable with the external thread 26 of the shell 22 for pulling the first and second shells 18, 22 together when the coupling ring 16 is rotated to thereby hold the contacts 20, 24 in mated relationship. The contacts 20, 24 are connected to wires formed into respective plug and receptacle cables which extend from the rear ends of the plug and receptacle subassemblies, respectively. The foregoing is conventional and well known in the art.

Figure 2:
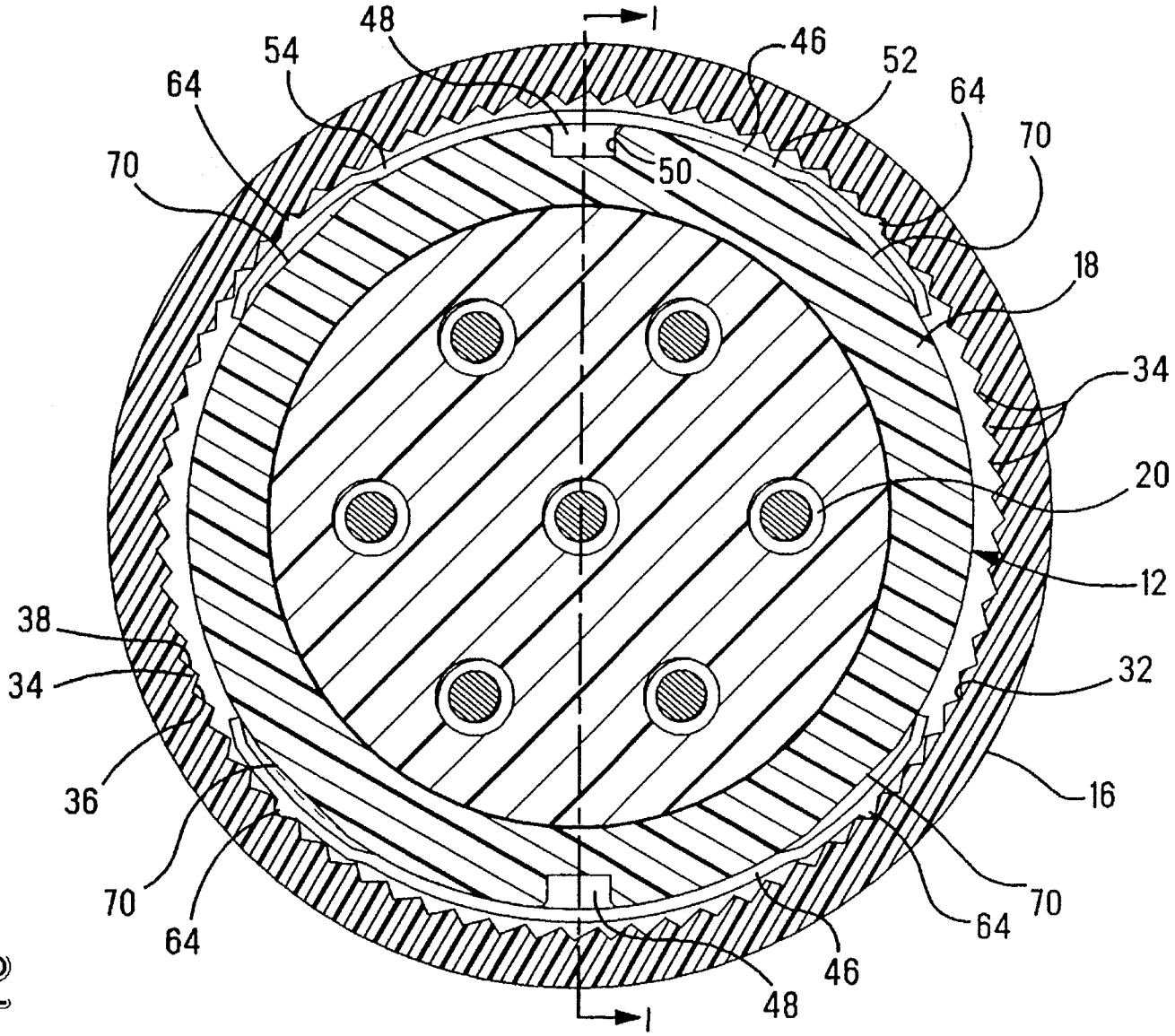
FIG. 2 is a cross sectional view taken along the line 2—2 in FIG. 1.

In accordance with this invention, an improved mechanism for retarding rotation of the coupling ring 16 with respect to the plug shell 18 is provided. The retardation mechanism includes an annular region 30 extending around the interior of the coupling ring 16. The annular region 30 has an inner circumferential surface 32 provided with a plurality of engageable teeth 34. As shown in FIG. 2, each of the teeth 34 has a generally straight first side 36 and a generally straight second side 38, with a pair of sides 36, 38 meeting at an apex, or crest, of each tooth 34. When viewed as in FIG. 2, the coupling ring 16 is rotated clockwise for coupling the first shell 18 to the second shell 22, and is rotated counterclockwise for decoupling the first shell 18 from the second shell 22. Thus, when the coupling ring 16 is rotated to decouple the shells 18, 22, the first side 36 of each tooth 34 leads the second side 38, and vice versa. In accordance with this invention, the first side 36 of each tooth has a steeper angle than the second side 38. This angular difference results in a greater resistance to decoupling rotation of the coupling ring 16 than it does to coupling rotation of the coupling ring 16, as will be described hereinafter.

The first shell 18 and the coupling ring 16 are so configured that when the coupling ring 16 is installed on the first shell 18, an annular channel is formed. Thus, as shown in FIG. 1, the coupling ring 16 is formed with an inwardly extending wall 40 which is immediately axially forward of the annular region 30 containing the teeth 34. The first shell 18 is formed with an outwardly extending wall 42 rearwardly spaced from the inwardly extending wall 40 so as to form the annular channel 44 therebetween. The outer surface of the channel 44 is thus occupied by the teeth 34.

Figure 3:
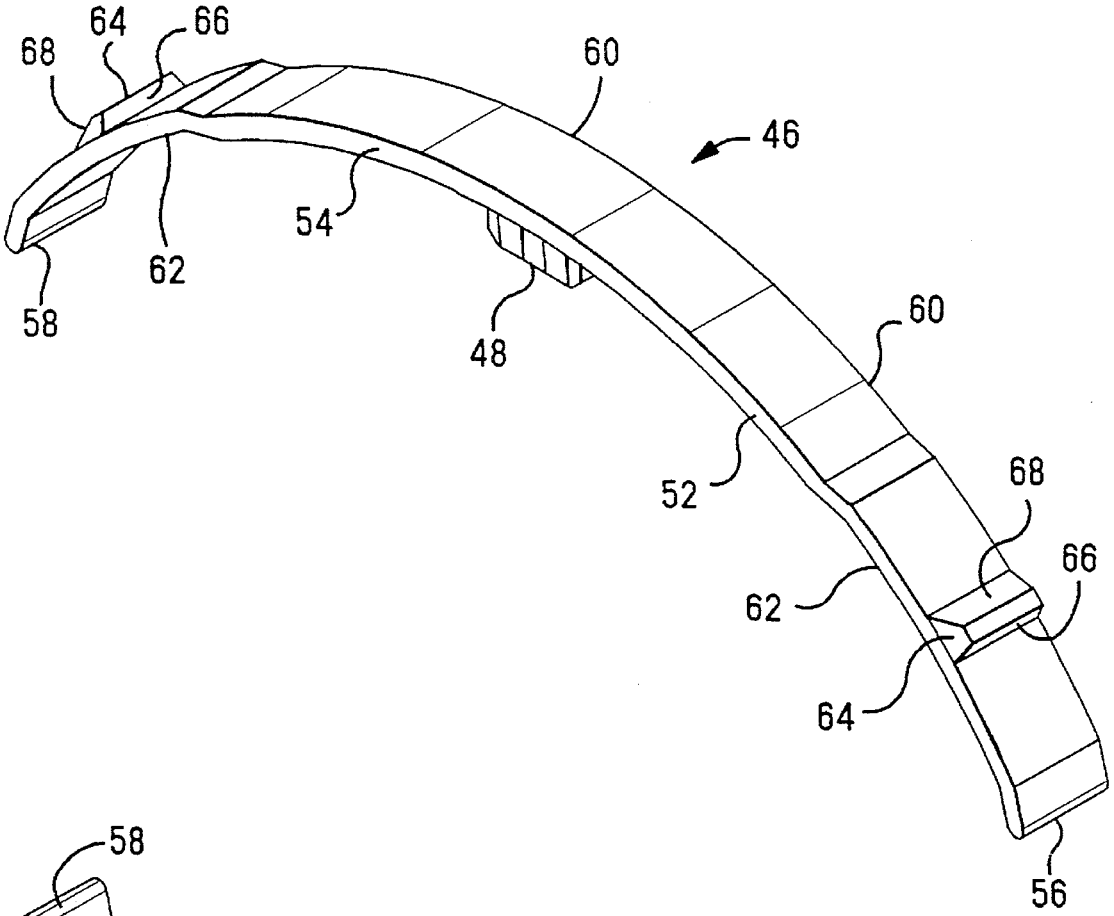
FIGS. 3 and 4 are isometric views taken from different angles of a first embodiment of a leaf spring member for use in the assembly of FIG. 1.
Figure 4:
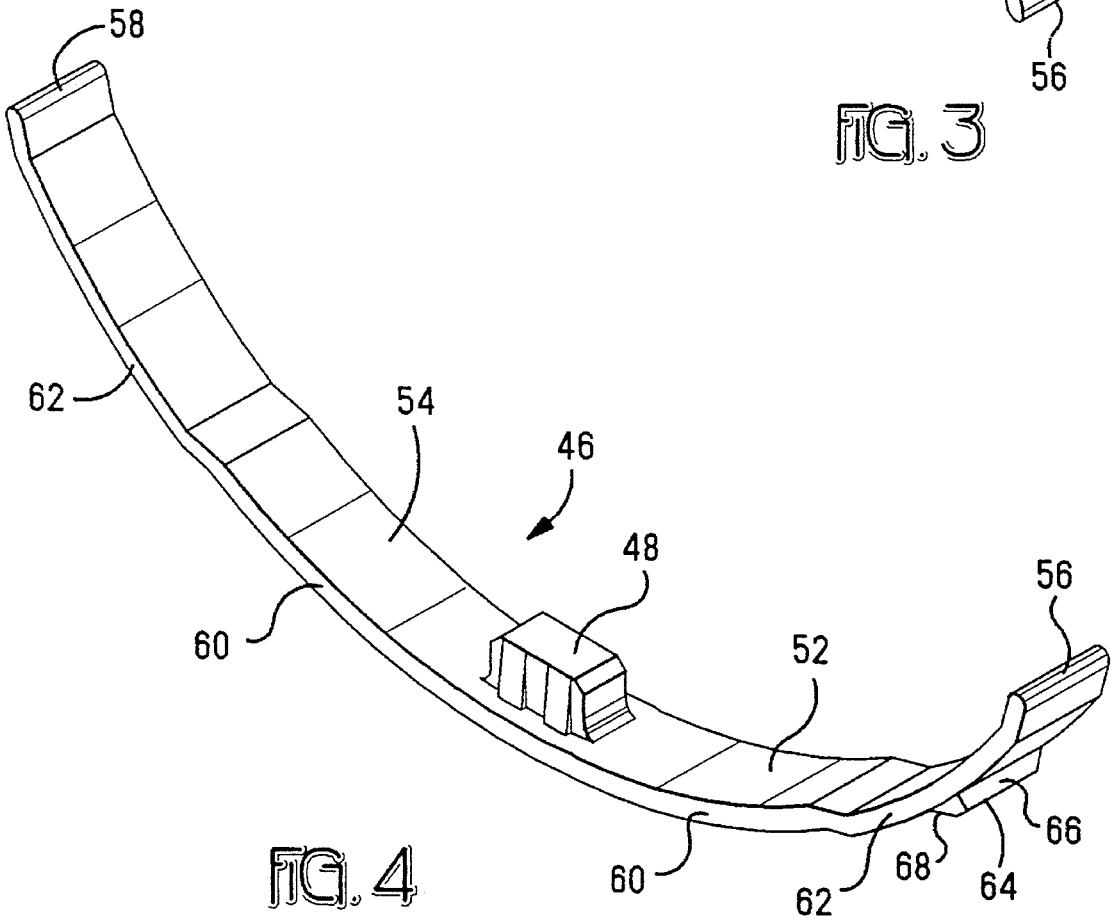

Disposed within the channel 44 is a pair of leaf spring members 46. The leaf spring members 46 are identical to each other and are situated in diametric opposition. The leaf spring members 46 shown in FIGS. 2–4 are each molded as a unitary piece from plastic, illustratively TORLON polyamide-imide resin, sold by AMOCO Performance Products, Inc. of Atlanta, Ga. Each leaf spring member 46 has a central portion 48 fitted into a cavity 50 formed in the outer periphery of the shell 18 within the annular channel 44. The leaf spring member 46 further includes a pair of wings 52, 54 extending within the channel 44 in opposite directions from the central portion 48, each wing extending to a respective distal end 56, 58 which is disposed against the exterior of the shell 18. Each of the wings 52, 54 has a generally arcuate first portion 60 of substantially the same radius as the exterior of the shell 18 within the channel 44 so that it lies on the exterior of the shell 18 within the channel 44. Between the arcuate portion 60 and the distal end 56, 58, each of the wings 52, 54 has a second portion 62 which is raised away from the exterior of the shell 18 so as to form a fixed beam. On each of the raised portions 62, there is a projection 64 for engaging the teeth 34. Like the teeth 34, each projection 64 has a generally straight first side 66 and a generally straight second side 68, with the first side 66 having a steeper angle than the second side 68. The first side 66 of the projection 64 is adapted to engage the first side 36 of the teeth 34 and the second side 68 of the projection 64 is adapted to engage the second side 38 of the teeth 34. Accordingly, the angles of the sides 66, 68 substantially match the angles of the sides 36, 38.

Under each of the raised portions 62 of the leaf spring members 46, the exterior of the shell 18 within the channel 44 is flatted, as shown at 70. Thus, when the coupling ring 16 is rotated and the raised fixed beam portion 62 of the leaf spring members 46 is forced inwardly, the flats 70 provide clearance for such movement.

Figure 5:
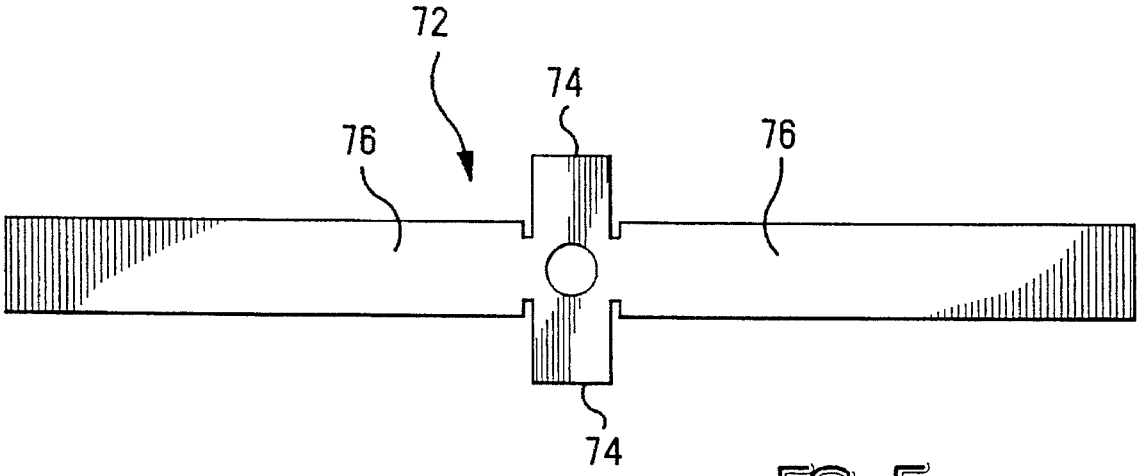
FIG. 5 is a plan view of a blank for forming a second embodiment of a leaf spring member for use in the assembly of FIG. 1.
Figure 6:
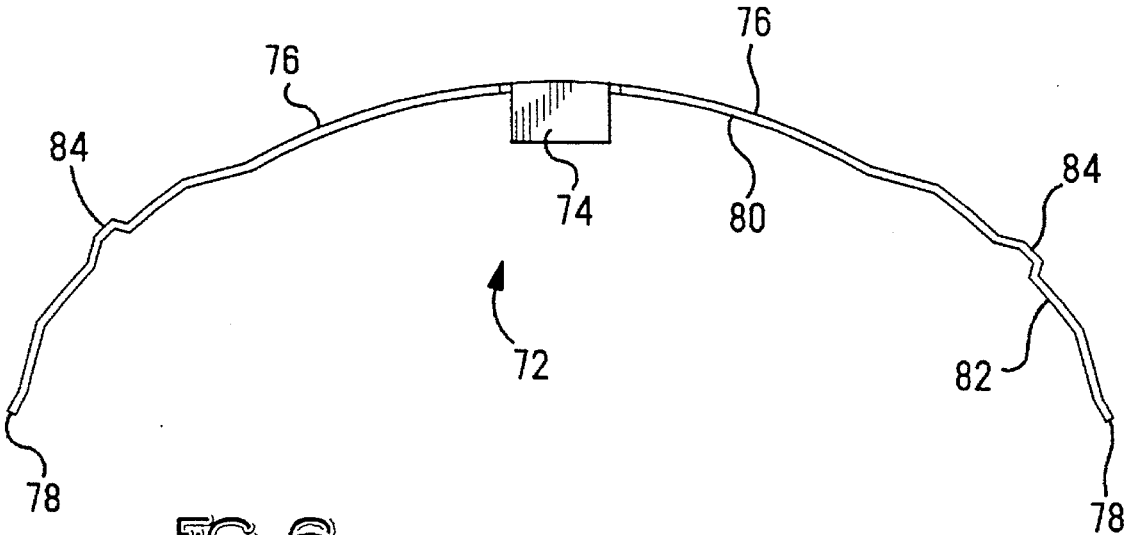
FIG. 6 is a side view of the second embodiment of the leaf spring member formed from the blank shown in FIG. 5.

FIGS. 5 and 6 disclose a leaf spring member 72 in accordance with a second embodiment of this invention. The leaf spring member 72 is stamped and formed from metal, illustratively stainless steel, as a unitary piece. The stamped blank is shown in FIG. 5 with oppositely extending and centrally located tabs 74. During the forming process, the tabs 74 are bent to form the central portion of the leaf spring member 72 which is mounted in the cavity 50. Extending outwardly in opposite directions from the tabs 74 are a pair of wings 76 having distal ends 78. Each of the wings 76 has a generally arcuate portion 80 and a raised portion 82. Formed as part of the raised portion 82 is a projection 84 for engaging the teeth 34.

As is clear from FIG. 1, the coupling ring 16 may be assembled to, and disassembled from, the forward mating end of the plug shell 18. Accordingly, the coupling ring 16 does not have to pass over the entire length of cable connected to the plug subassembly 12. When the coupling ring 16 is assembled to the plug shell 18, the inwardly extending wall 40 cannot pass the abutment 90. The coupling ring 16 is kept in place by a spiral ring retainer 86, which fits into an internal groove 88 in the coupling ring 16 immediately rearward of the outwardly extending wall 42 of the shell 18, to thereby prevent subsequent forward axial movement of the coupling ring 16 with respect to the shell 18.

Since the first side 36 of each tooth 34 and the first side 66 of the projection 64 is steeper than the second side 38 of each tooth 34 and the second side 68 of the projection 64, more torque is required to rotate the coupling ring 16 in the counterclockwise direction, as viewed in FIG. 2, which corresponds to decoupling the shells 18, 20, than is required to rotate the coupling ring 16 in the clockwise direction. Therefore, once the shells 18, 22 have been coupled, expected vibrational forces are insufficient to decouple the shells.

A particular application of the disclosed connector assembly 10 must meet strict military specifications. The following Table I is illustrative of such a specification.

TABLE I

| Shell Size | Coupling/Decoupling Torque: Maximum Engagement and Disengagement Newton Meters | Coupling/Decoupling Torque: Minimum Disengagement Newton Meters |
|---|---|---|
| 8 | 0.9 | 0.2 |
| 9 | 0.9 | 0.2 |
| 10 | 1.4 | 0.2 |
| 11 | 1.4 | 0.2 |
| 12 | 1.8 | 0.2 |
| 13 | 1.8 | 0.2 |
| 14 | 2.3 | 0.4 |
| 15 | 2.3 | 0.3 |
| 16 | 2.7 | 0.4 |
| 17 | 2.7 | 0.3 |
| 18 | 3.2 | 0.6 |
| 19 | 3.2 | 0.3 |
| 20 | 3.6 | 0.7 |
| 21 | 3.6 | 0.6 |
| 22 | 4.1 | 0.8 |
| 23 | 4.1 | 0.6 |
| 24 | 4.1 | 0.8 |
| 25 | 4.6 | 0.6 |

A feature of the aforedescribed design not known to be present in previous designs is that the width of the channel 44 is only slightly greater than the width of the leaf spring member 46 or 72. This provides clearance for the leaf spring member 46, 72 to be fitted within the channel 44 while at the same time preventing the leaf spring member 46, 72 from skewing. If the leaf spring member 46, 72 were to skew, its interaction with the teeth 34 would be affected, thereby impacting the effectiveness of the retardation mechanism.

An additional feature of the disclosed design is that the leaf spring member 46, 72 has a fixed beam at both its ends. Thus, both ends of the raised portion 62, 82 ride on the exterior of the shell 18 within the channel 44. This results in more control of the loading forces than in the situation where the leaf spring member is a simple beam fixed only at one end.

Accordingly, there has been disclosed an improved decoupling retardation mechanism for an electrical connector assembly. While illustrative embodiments of the present invention have been disclosed herein, it is understood that various modifications and adaptations to the disclosed embodiments will be apparent to those of ordinary skill in the art and it is intended that this invention be limited only by the scope of the appended claims.

What is claimed is:

1. An electrical connector assembly comprising:

an electrical plug connector subassembly including a substantially cylindrical first shell having at least one first electrical contact secured therein;

an electrical receptable connector subassembly including a substantially cylindrical second shell having at least one second electrical contact secured therein each mateable with a respective said first contact in the first shell, said second shell having an external thread thereon;

a coupling ring rotatably mounted on the first shell and restrained from axial movement with respect thereto, said coupling ring being adapted to selectively couple and decouple said first shell and said second shell, said coupling ring having an interior wall provided with an internal thread connectable with the external thread on the second shell for connecting the first and second shells together and thereby holding said first and second contacts in mated relationship; and means for retarding rotational movement of the coupling ring with respect to the first shell, said retarding means comprising:

an annular region extending around the interior of said coupling ring and having an inner circumferential surface thereof provided with a plurality of engageable teeth, each of said teeth having first and second generally straight sides meeting at an apex, said first side having a steeper angle than said second side, with said first side leading said second side when said coupling ring is rotated to decouple said first shell from said second shell;

an annular channel formed by an inwardly extending wall of said coupling ring and an outwardly extending wall of said first shell, said channel being so located that said teeth occupy its outer surface between said walls; and a leaf spring member having a central portion mounted to said first shell within said channel and a pair of wings extending within said channel in opposite directions from said central portion each to a respective distal end disposed against the exterior of said first shell, each of said wings having a first generally arcuate portion extending from said central portion and disposed against the exterior of said first shell within said channel, and a second portion between said first portion and the distal end of said each wing with ends of said second portion adapted to engage the exterior of said first shell within said channel so that said second portion is raised away from the exterior of said first shell and biased against inner circumferential surface, and each said second portion of said wings having a radially outwardly extending projection engaging and yieldably biased against said teeth to retard rotational movement of said coupling ring; whereby more torque is required to decouple said shells than to couple said shells.

2. The connector assembly according to claim 1 wherein each said projection is generally centered with respect to said ends of a respective said second portion.

3. The connector assembly according to claim 1 wherein the exterior of said first shell within said channel is flatted under the second portion of each of said wings.

4. The connector assembly according to claim 1 wherein said leaf spring member is stamped and formed from metal as a unitary piece.

5. The connector assembly according to claim 3 wherein said leaf spring member is molded from plastic as a unitary piece.

6. The connector assembly according to claim 1 wherein said retarding means comprises a pair of said leaf spring members disposed on said first shell diametrically opposite each other.

7. The connector assembly according to claim 1 wherein the width of said channel in the axial direction provides slight clearance for said leaf spring member and prevents said leaf spring member from skewing.

8. The connector assembly according to claim 1 wherein said inwardly extending coupling ring wall is axially forward of said outwardly extending first shell wall so that said coupling ring is axially removable from a forward mating end of said plug connector subassembly, and said connector assembly further includes a retainer adapted to secure said coupling ring to said first shell so that said coupling ring is rotatably but not axially movable thereon.

* * * * *